United States Patent [19]

Goldfarb et al.

[11] 4,186,925

[45] Feb. 5, 1980

[54] COMPETITIVE TOSS GAME

[75] Inventors: Adolph E. Goldfarb, 4614 Monarca Dr., Tarzana, Calif. 91356; Erwin Benkoe, deceased, late of Encino, Calif.; Don Robinson, Manhattan Beach, Calif.

[73] Assignees: Adolph E. Goldfarb; Elisabeth Benkoe, executrix for the estate of Erwin Benkoe, both of Northridge, Calif.

[21] Appl. No.: 876,659

[22] Filed: Feb. 10, 1978

[51] Int. Cl.[2] ..... A63B 63/04

[52] U.S. Cl. ..... 273/389; 273/390; 273/127 D; 273/415

[58] Field of Search ..... 273/95 R, 101, 102 R, 273/102 AP, 102.1 E, 105 R, 127 D

[56] References Cited

U.S. PATENT DOCUMENTS

| | | | |
|---|---|---|---|
| 3,599,977 | 8/1971 | Glass | 273/102 R X |
| 3,749,401 | 7/1973 | Hayko | 273/95 R |
| 3,990,703 | 11/1976 | Evans | 273/105 R X |
| 4,012,042 | 3/1977 | Blasingame | 273/95 R |
| 4,116,443 | 9/1978 | Dorfman | 273/102.1 E X |

*Primary Examiner*—Richard J. Apley

*Attorney, Agent, or Firm*—Robert M. Ashen; Robert J. Schaap

[57] ABSTRACT

A competitive toss game where each player has tossable play objects such as bean bags and there is a target apparatus with one or more receptacles each having a pivotally mounted flippable lid. Each lid is provided with an opening large enough for a bean bag to be tossed directly into the associated receptacle. The bean bags of each player bear an encoding or indicia, with the indicia being different for each player. Thus, the bean bags of one player may be one color and the bean bags of the other player may be a different color. The lids have different indicia on each side, the indicia on one side matching the indicia of one player's bean bags, the indicia on the other side matching the indicia of the other player's bean bags. The players may take turns tossing their bean bags at the target apparatus, with each player attempting to toss his or her bean bags into the receptacles and to engage the lids with his or her bean bags so as to cause the sides of the lids with indicia matching the indicia on his or her bean bags to face upwardly. Scoring may be based on the orientation of the lids as well as bean bags in the receptacles. The pivoting of the lids may be limited or controlled so that they will reverse when engaged by a bean bag in one area but not in another.

17 Claims, 6 Drawing Figures

COMPETITIVE TOSS GAME

There have been various types of competitive toss or throw games using bean bags, balls and other throwable objects. For example, there have been games where bean bags were thrown in an attempt to release a spring loaded arm which would toss a ball that then was to be caught by the player.

The present invention is of the general type where there are a plurality of throwable objects such as bean bags and there is a target structure having one or more movable or tiltable sections which move between two or more possible positions when struck by one of the throwable objects.

There was a prior art game of this general nature involving the game of tic-tac-toe where there were three parallel rows with three sections in each row and each of the sections carry an "X", an "O" and a blank side. The players took turns tossing bean bags at the target apparatus to attempt to create a line of X's or O's and to prevent the opponent from creating a line of the other designation.

The apparatus of the present invention provides a particularly exciting and interesting game wherein the players must utilize substantial skill to not only orient tiltable or movable sections in desired ways, but also so as to cause the tossable objects to be received in areas or receptacles associated with the movable sections and in relation to the positioning of such sections. In this connection, there may be a direct entrance to the area beyond each section which permits a throwable object to be tossed into such area without engaging or moving a section.

In one form, each of the tiltable sections has a different color on each surface, one color correlating to each player. The players each have a plurality of throwable objects which may be bean bags and a player's objects may be the same color as the color on his side of the sections. In one form of game play, each player may attempt to get as many as possible of his or her colored bean bags into areas below tiltable sections which have his or her color facing upwardly. Bags in areas where the opponent's color is facing upwardly would not count. To increase the level of skill and interest in the game, each section may have a passageway or opening therethrough so that the players can attempt to toss bean bags directly through such opening. Similarly, the sections may be arranged so that they will move or tilt when struck in certain portions but will not move or tilt when struck in other portions. Thus, in the play of this form of game, each player would attempt to strike the sections to turn them so his or her color was upward and would also attempt to get as many of his or her bean bags as possible into the areas below such sections. The player would attempt this by throwing bean bags directly through the openings in the sections and/or by causing the sections to flip over when bean bags of his or her color were on the sections to dump the bean bags into the area below. The other player, of course, tries to accomplish just the opposite to maximize the number of bean bags of his or her color in areas where the sections have his or her color facing upwardly.

Referring now to the drawings.

Figure 1:
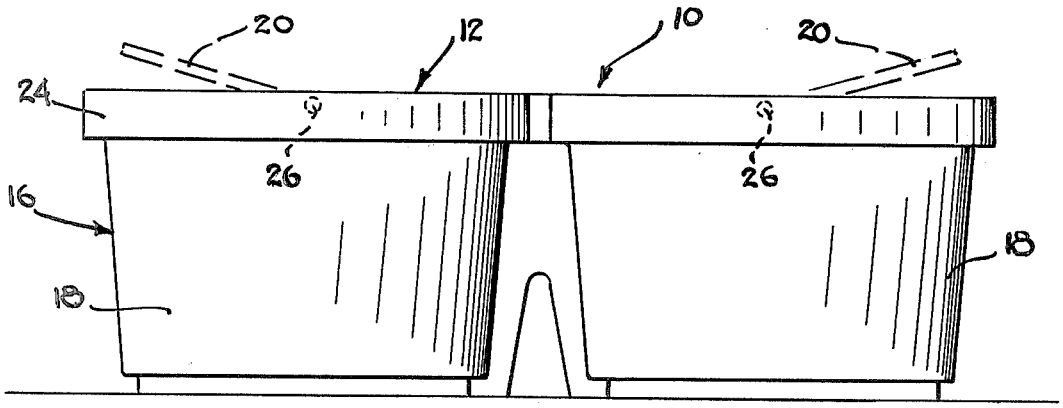
FIG. 1 is a side elevational view of a target apparatus comprising a portion of a presently preferred embodiment of the invention.
Figure 3:
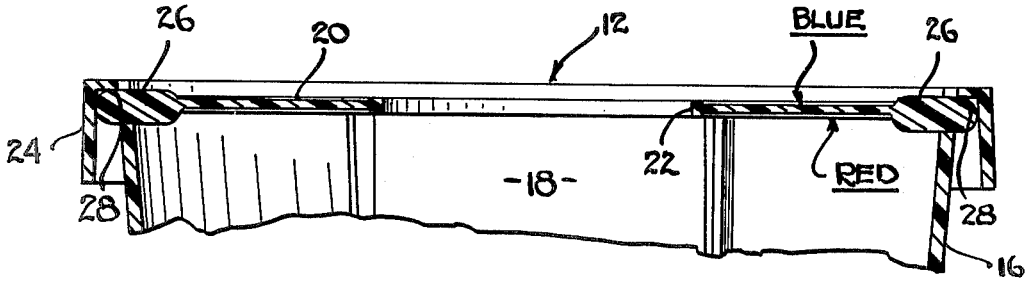
FIG. 3 is a sectional view, partially broken away, taken generally along the line 3—3 of FIG. 2.
Figure 4:
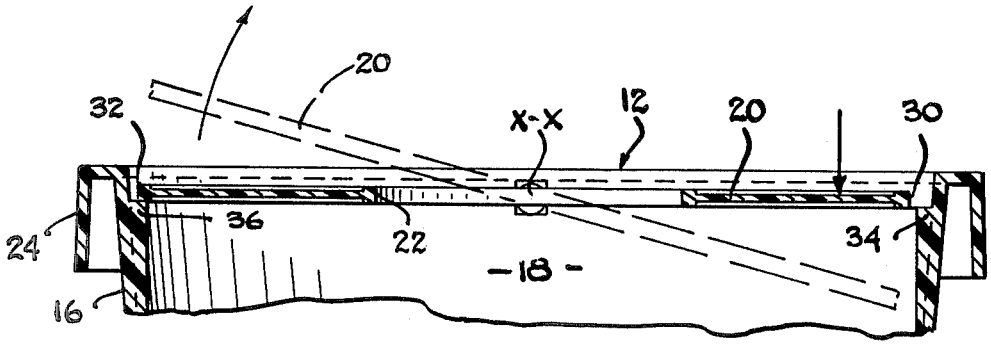
FIG. 4 is a sectional view, partially broken away, taken generally along line 4—4 of FIG. 3.
Figure 5:
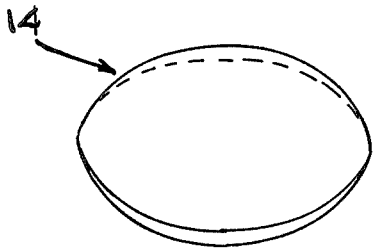
FIG. 5 is a perspective view of a throwable object in the form of a bean bag usable with the illustrated target apparatus and also comprising a part of the presently preferred embodiment of the invention.

In general, the illustrated play apparatus 10 comprises a target structure 12 as illustrated in FIGS. 1 through 4, and a plurality of throwable objects such as the bean bags 14 illustrated in FIG. 5. The illustrated form of target apparatus 12 comprises in general a housing 16 defining a pair of upwardly open receptacles 18 positioned adjacent to one another and each having a tiltable lid section 20 pivotally mounted and extending across the open upper end of the associated receptacle. Each lid section 20 has an opening 22 for direct passage of a bean bag 14 into the receptacle 18 below. Means are provided to permit each lid section 20 to tilt about its pivotal support to flip or turn over when certain portions of it are struck, but to resist such flipping when other portions of it are struck. Each lid section 20 has different indicia, such as a different color on each side. Each indicia or color on the lid sections may correlate with the indicia or color of the throwable objects of one of the players. For example, the lid sections may be red on one side and blue on the other, and one player may have red bean bags and the other player blue bean bags.

More particularly, the frame or housing 16 may be formed of a suitable material such as molded plastic, metal, wood, etc. The housing 16 is shown standing upon a supporting surface such as a table or the floor. The housing 16 defines a pair of generally tub-like receptacles 18 which are open at their upper ends. A rim 24 is formed around the upper end or entrance to each receptacle. Each receptacle entrance is generally circular and a generally flat circular cover or lid section 20 that is slightly smaller than the entrance is pivotally mounted on the rim. Each lid section 20 is pivotally mounted for rotation about a generally horizontal axis x—x forming a diameter of the lid section as shown best in FIGS. 2 and 3. Each lid section 20 may have a pair of opposed outwardly extending fingers or shaft stubs 26 received in mating notches 28 in the rim 24 around the upper edge of the associated receptacle. The rims may be separate pieces, or the lid and the housing may be of sufficiently flexible material so that the parts may be deflected and the fingers 26 inserted into the notches 28 in the position shown in FIGS. 2 and 3. The game may include only a single receptacle, or it could include more than two receptacles.

Each of the lid sections 20 is provided with the circular opening or aperture 22 at its center which is sufficiently large for the passage of one of the throwable bean bags 14 therethrough and into the associated receptacle 18. The lid sections may be constructed of a material like that from which the housing is constructed or they may be of a different material. The receptacles and lid sections could be shaped other than circular, as for example oblong or straight sided. The shape of the apertures in the lid sections could be other than round also.

Figure 2:
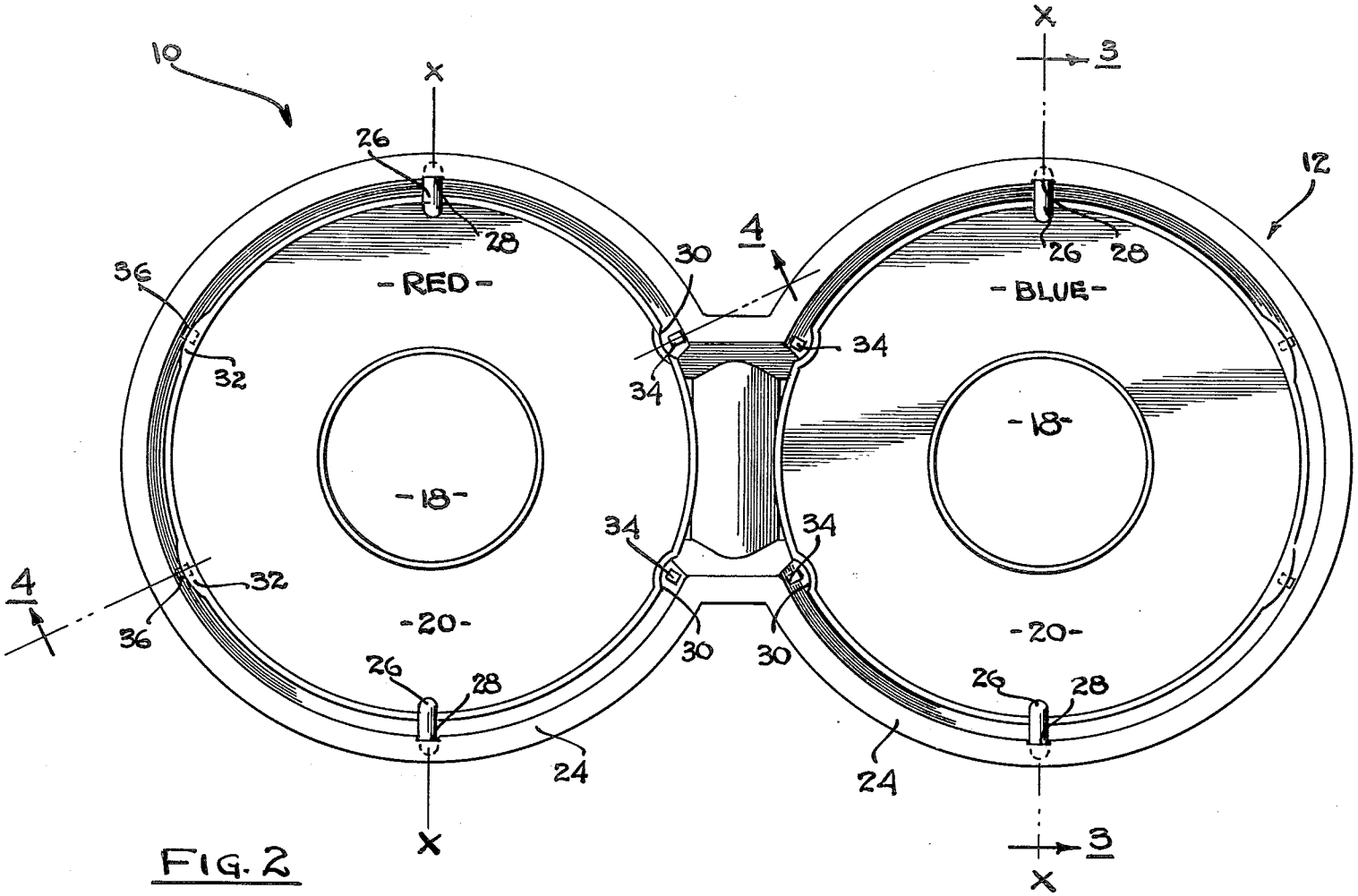
FIG. 2 is an enlarged top plan view of the target apparatus.

Means are provided in the illustrated apparatus which permit each lid section 20 to pivot in one direction about its axis x—x while limiting its pivotal movement in the opposite direction. More particularly, as shown in FIGS. 2 and 4, each lid section 20 is formed at its periphery with a pair of notches or recesses 30 and with a pair of projections 32. The notches 30 are on one side of the pivotal axis x—x while the projections 32 are on the other side of that axis. The entrance of each receptacle 18 is provided with two pairs of interior ribs 34, 36 forming stops. The ribs or stops 34, 36 of each receptacle are aligned with the notches 30 and the projections 32 of the associated lid section. The notches 30 in the lid sections pass freely by the stops 34, 36 while the projections 32 on the lid sections engage and are stopped by the stops 34, 36 to thus stop the lid section from further rotation. Thus, as shown in FIG. 4, the projection 32 as shown at the left-hand side of FIG. 4 is engaging a stop 36 while the notch 30 as shown at the right-hand side of FIG. 4 is adjacent to a stop 34. This permits the lid section 20 to be rotated in the clockwise direction as viewed in FIG. 4, but prevents its rotation in a counter-clockwise direction. Therefore, if one of the bean bags 14 strikes the left-hand portion of the lid section 20, the lid section cannot rotate and the bean bag will be supported upon that portion of the lid section. On the other hand, if the bean bag strikes the right-hand portion of the lid section, the lid section will pivot as indicated by broken lines in FIG. 4 and the bean bag will drop into the associated receptacle. Further, the lid section 20 will tend to continue in a clockwise rotation until the projections 32 engage the stops 34 at the right-hand side of FIG. 4. Now the reverse is true and the lid section can only be flipped if it is struck in the portion disposed at the left-hand side as viewed in FIG. 4. It will be noted that the bean bag can enter the receptacle directly by passing through the central opening 22 without causing flipping of the lid section or coming to rest upon the lid section.

Opposite sides of the lid sections 20 may have different indicia or encoding, each associated with one of the players. For example, one side of the lid sections may be one color such as red and the opposite sides may be another color such as blue. Each of the players may have a plurality of throwable objects such as the bean bags 14 having indicia or encoding corresponding to the indicia on one of the sides of the lid sections. Thus a player assigned the blue side of the lid sections may have a plurality of blue-colored bean bags while the other player assigned the opposite or red side of the lid sections may have a plurality of red-colored bean bags.

Instead of color encoding, the indicia could be different names, or numbers, etc. Further, tossable objects other than bean bags might be utilized, as for example balls or molded objects.

As noted above, in the play of the game the players may take turns tossing bean bags toward the target apparatus. The object of each player is to get the lid sections turned so that his or her color is face up and so that his or her bean bags are in the receptacles. In one form of play of the game a player only gets credit for bean bags of his or her color if they are in a receptacle where the lid section has his or her color facing upwardly. Thus, if a player has bean bags in a receptacle where the lid section of his opponent is facing upwardly, the player would not get credit for those bean bags. The players may play offensively in trying to get their bean bags directly into a receptacle as by throwing them through one of the apertures in the lid sections or by flipping a lid section so that the bean bag they are throwing and/or other of their bean bags already on that lid section will be deposited into the associated receptacle. They also may play defensively in trying to flip the lid section of receptacles where the opponent has bean bags to prevent the bean bags in such receptacles from being scored to the opponent.

Figure 6:
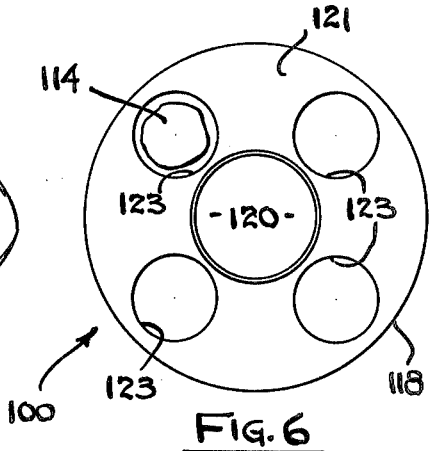
FIG. 6 is a top plan view of a modified form of target apparatus.

FIG. 6 shows a modified form of target apparatus 110. The lid sections 120 do not have openings, but instead the housing wall 121 around the lid sections is enlarged and has openings 123 therethrough. Each opening 123 is large enough for one of the throwable objects 114 to pass through it and into the receptacle 118 below.

It should be understood that the target apparatus 10 or 100 could be tilted so that the lid sections are disposed at some angle to the horizontal.

What is claimed is:

1. A competitive toss game apparatus for two players comprising:

(a) a plurality of tossable play objects for each player, the objects for each player having indicia thereon associated with that player, indicia on the objects of each player being different from the indicia on the objects of the other player, (b) a frame for being disposed on a supporting surface, (c) a plurality of tiltable sections movably supported on said frame above the supporting surface and each overlying a receiver area, said sections each having a plurality of surfaces with indicia thereon, at least one of said surface indicia being related to said object indicia for one player and at least another of said surface indicia being related to said object indicia for the other player, said sections each being supported for movement incident to being engaged by one of said play objects between a first position where one of its said surface indicia is exposed and a second position where a different one of its surface indicia is exposed, said apparatus being constructed and arranged to permit play objects to enter each receiver area without moving the associated section to a different one of its said positions, whereby each player may attempt to toss his or her play objects so as to cause them to directly enter receiver areas or to engage said sections so that desired indicia surfaces are exposed, said sections each comprising a generally flat disc having opposite faces, said sections each being pivotally mounted for rotation about a generally horizontal transverse axis disposed generally centrally of said disc so that said discs can each pivot to have opposite faces exposed upwardly, each of said discs having an opening large enough for passage therethrough of one of said play objects.

2. The game apparatus of claim 1 wherein said frame defines a receptacle below each of said movable sections and enclosing the associated receiver area.

3. The game apparatus of claim 1 further including means between each of said discs and said frame to limit said pivotable movement in one direction but not in the other.

4. The game apparatus of claim 3 wherein each of said discs have at least one peripheral notch at one side of its said axis, and at least one peripheral projection at the other side of its said axis, and aligned with said notch along a line generally transverse to its said axis, and said frame has stop means also aligned with said notch and projection so as to engage said projection but not said notch to thereby limit rotation of said disc.

5. The game apparatus of claim 1 wherein one face of each said disc is one color and comprises the surface with the indicia for one of the players and the other face of each said disc is a different color and comprises the surface with the indicia for the other of the players.

6. The game apparatus of claim 5 wherein said objects for one of the players are the same color as said one face of said discs and the objects for the other of the players are the same color as the said other face of said discs.

7. The game apparatus of claim 1 wherein said tossable play objects comprise bean bags.

8. A competitive toss game apparatus for two players comprising:

(a) a plurality of tossable play objects for each player, the objects for each player having encoding thereon associated with that player, encoding on the objects of each player being different from the encoding on the objects of the other player, (b) a frame, (c) a tiltable section movably supported on said frame overlying a play object receiver area, (d) said apparatus having an opening communicating with and leading into said object receiver area, said opening being large enough for one of said play objects to pass therethrough, said tiltable section having a plurality of surfaces with encoding on each of said surfaces, at least one of said surface encodings being related to said object encoding for one player and at least another of said surface encodings being related to said object encoding for the other player, said tiltable section being movable, in response to being engaged by one of said tossable objects, between a first position where one of its said surface encodings is exposed and a second position where a different one of its said surface encodings is exposed, said engaging object entering the receiver area when said tiltable section is so moved, said tiltable section being located in relatively close proximity to said opening, whereby a player may attempt to throw an object at the tiltable section and have the object enter the receiver area in response to movement of the tiltable section or the player may attempt to throw the object directly through the opening.

9. The game apparatus of claim 8 wherein said opening is located in said tiltable section.

10. The game apparatus of claim 8 wherein there are a plurality of said tiltable sections.

11. The game apparatus of claim 8 wherein said play objects are bean bags.

12. The game apparatus of claim 8 wherein said apparatus comprises a receptacle defining said receiver area.

13. The game apparatus of claim 8 wherein there are means between said frame and said tiltable section to limit said movement of said tiltable section.

14. A competitive toss game apparatus for two players comprising:

(a) a plurality of tossable play objects for each player, the objects for each player having indicia thereon associated with that player, indicia on the objects of each player being different from the indicia on the objects of the other player, (b) a housing having at least one receptacle with an entrance, a generally flat tiltable lid section pivotally supported on said housing at the entrance to said receptacle for pivotal movement about an axis extending generally centrally of said lid section, said lid section having opposed surfaces with indicia thereon, one of said surface indicia being related to said object indicia for one player and the other of said surface indicia being related to said object indicia for the other player, said lid section being supported for pivotal movement incident to being engaged by one of said play objects between a first position where one of its said surface indicia is exposed and a second position where the other one of its said surface indicia is exposed, means between said lid section and said housing to limit said pivotal movement in one direction but not in the other, said apparatus including means to permit play objects to directly enter said receptacle without moving the lid section to a different one of its said positions, whereby each player may attempt to toss his or her play objects so as to cause them to directly enter the receptacle or to so engage said lid section so that the desired indicia surface will be exposed.

15. The game apparatus of claim 14 wherein said lid section has an opening large enough for passage of one of said tossable objects therethrough.

16. The game apparatus of claim 14 wherein there are a plurality of said receptacles and said lid sections.

17. The game apparatus of claim 14 wherein said play objects are bean bags.

* * * * *